US009003851B2

(12) United States Patent
Obata et al.

(10) Patent No.: US 9,003,851 B2
(45) Date of Patent: Apr. 14, 2015

(54) EMBOSSING DEVICE, EMBOSSING METHOD, AND EMBOSSED CAN

(75) Inventors: Kazumoto Obata, Yokohama (JP); Keiji Sasaki, Yokohama (JP); Wataru Ookubo, Yokohama (JP); Masayuki Nakamura, Yokohama (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 500 days.

(21) Appl. No.: 13/375,916

(22) PCT Filed: May 28, 2010

(86) PCT No.: PCT/JP2010/003588

§ 371 (c)(1),
(2), (4) Date: Dec. 2, 2011

(87) PCT Pub. No.: WO2010/140327

PCT Pub. Date: Dec. 9, 2010

(65) Prior Publication Data

US 2012/0074018 A1 Mar. 29, 2012

(30) Foreign Application Priority Data

Jun. 5, 2009 (JP) ..... 2009-136094

(51) Int. Cl.

| | |
|---|---|
| ***B21D 22/04*** | (2006.01) |
| ***B21D 22/18*** | (2006.01) |
| ***B21D 51/26*** | (2006.01) |

(52) U.S. Cl.

CPC ..... *B21D 51/2692* (2013.01); *B21D 51/2607* (2013.01)

(58) Field of Classification Search

USPC ..... 72/105–109, 379.4, 405, 15.2, 15.33, 72/84, 85, 17.3, 11.1, 420, 421

See application file for complete search history.

(56) References Cited

U.S. PATENT DOCUMENTS 6,338,263 B1 * 1/2002 Obata et al. ..... 72/105

FOREIGN PATENT DOCUMENTS

| | | | |
|---|---|---|---|
| JP | 2000-515071 | A | 11/2000 |
| JP | 2001-9547 | | 1/2001 |
| JP | 2001-30033 | | 2/2001 |
| JP | 2001-047165 | | 2/2001 |
| JP | 2005-531428 | A | 10/2005 |
| JP | 2009-028792 | | 2/2009 |
| WO | WO 2009/044569 | A1 | 4/2009 |

* cited by examiner

*Primary Examiner* — Debra Sullivan
(74) *Attorney, Agent, or Firm* — Manabu Kanesaka

(57) ABSTRACT

To provide an embossing device, an embossing method and an embossed can which are capable of conducting embossing having a non-shaped section and an arbitral number of embossed areas, and are capable of improving quality or productivity.

An embossed can 10 is a double-embossed surface can in which on a can barrel 101 a first pattern 104 is printed; a first concave part 105 is formed in the state that it is so positioned as to almost conform to the first pattern 104; a second pattern 106 is printed at a position which is distant in the circumferential direction with the non-shaped section therebetween; and a second concave portion 107 is formed in the state that it is so positioned as to almost conform to the second pattern 106.

3 Claims, 7 Drawing Sheets

EMBOSSING DEVICE, EMBOSSING METHOD, AND EMBOSSED CAN

RELATED APPLICATIONS

The present application is National Phase of International Application No. PCT/JP2010/003588 filed May 28, 2010, and claims priority from Japanese Application No. 2009-136094 filed Jun. 5, 2009.

TECHNICAL FIELD

The present invention relates to an embossing device, an embossing method and an embossed can.

BACKGROUND ART

In recent years, because of diversification in design, improvement in strength of a can barrel with a decrease in thickness of a can barrel or for other reasons, a can of which the can barrel has been processed (embossed) to have convex parts and/or concave parts thereon (embossed can) has been developed and put on the market.

If processing is conducted such that convex parts and/or concave parts are formed so as to conform to patterns, characters or the like (hereinafter, they are named generically as "patterns" in this specification) which have been printed on a can barrel, the design of the can body is enhanced. Therefore, processing has been conducted to form concave parts and/or convex parts in at least part of a pattern such that they conform to the pattern.

In general, an embossed can means a can which is shaped while being so positioned to a prescribed design (including a design composed of concave parts and/or convex parts, with no pattern being printed).

For example, Patent Document 1 discloses a technology of a can characterized in that a pattern is printed on the outer peripheral surface of a can barrel and at least part of the pattern is processed to have convex parts and/or concave parts so as to be positioned to the pattern, and two or more positioning marks for positioning the pattern to a predetermined position are formed on the outer peripheral surface.

Further, Patent Document 2 discloses a technology of a method for producing an embossed can body in which a pattern is printed on the outer peripheral surface of a cylindrical can barrel, and, at least part of the pattern is subjected to embossing to have convex parts and/or concave parts so as to be positioned to the pattern, wherein a plastic processing step of forming a plastically deformed part by conducting deformation processing on the part of outer surface of a can barrel is provided prior to an embossing processing step in which positioning to a pattern is conducted and convex parts and/or concave parts (embossing) are formed.

Patent Document 3 discloses a method of processing a can barrel in which predetermined processing is conducted on a barrel of a can body having a barrel and a bottom provided on the one side of this barrel, wherein a stopping mark is provided on the downstream side of the rotation direction and a confirmation mark is provided on the upstream side of the rotation direction are provided on the barrel as positioning marks, a conformation sensor is provided on the upstream side of the rotation and a stopping sensor is provided on the downstream side of the rotation in the positioning step for conducting rotational positioning, when the stopping mark is detected by the confirmation sensor, the rotation of the can barrel is slowed down and, when the stopping mark is detected by the stopping sensor, the can barrel is stopped, and when the rotation of the can barrel is stopped, it is determined whether the rotational positioning of the can barrel is accurately conducted or not by whether the confirmation mark is detected by the confirmation sensor or not.

Further, Patent Document 4 discloses a technology of positioning a printed design of a can barrel in which, before a can barrel is processed in conformity to a design which has been printed on the outer surface of the can barrel beforehand, respective cans which are continuously transferred in the state that the printed design is positioned at a random position are rotated in the circumferential direction of the can barrel at a high speed and then a can rotation speed is lowered at the timing when a large mark printed on the can barrel is detected by a sensor, successively, rotation of the can is stopped when a small mark printed on the can barrel is detected, whereby positioning of the printed design is conducted.

RELATED ART DOCUMENTS

Patent Documents

Patent Document 1: JP-A-2001-9547
Patent Document 2: JP-A-2001-30033
Patent Document 3: JP-A-2009-28792
Patent Document 4: JP-A-2001-47165

SUMMARY OF THE INVENTION

Problems to be Solved by the Invention

However, in the technology of each of the above-mentioned patent documents, a match mark (mark for positioning) provided on the can barrel is detected, the can barrel is rotated by a driving means such as a stepping motor, thereby to conduct positioning of the can barrel. As a result, the rotation of the can barrel is stopped. Subsequently, the can barrel, which is rotatable held, is subjected to embossing while being rotated by engaging between the convex parts and concave parts of the inner roll and the outer roll. At this time, while the inner roll and the outer roll are rotated at a circumferential speed of several hundreds mm/sec, the can barrel which has been stopped rotating rotates almost instantly at a circumferential speed of several hundreds mm/sec by being engaged between the convex parts and the concave parts of the inner roll and the outer roll. Therefore, variations in embossing position relative to the design are larger than positional variations of the can barrel relative to the design. That is, in order to attain further improvement in embossing position accuracy relative to the design, it is required to reduce significantly and effectively variations in embossing position which occur at the time of engagement.

Further, normally, in an adjustment operation in which the embossing position is adjusted to the design, it was necessary to move a positioning sensor manually in the circumferential direction of a can to conduct position adjustment. Since this position adjustment requires accuracy of 0. several mm or less, a long period of time is taken to adjust the embossing position to the design. That is, it is necessary to improve productivity or the like.

Further, in canned coffee or the like, the design of a can is important since it affects greatly the sales or the like. Therefore, a technology which is capable of realizing an innovative design has been demanded. For can manufacturers, to establish a technology of capable of realizing an innovative design to meet the demand of customers is significantly important in order to allow them to be differentiated from other manufactures.

For example, in conventional technologies, it was impossible to produce an embossed can having two embossed sections which are distant from each other in the circumferential direction with a non-shaped section (hereinafter, appropriately referred to as the "double-embossed surface can") (see FIG. 7).

The reason therefor is that, as mentioned above, the can barrel which has been positioned and has stopped rotating rotates almost instantly at a circumferential speed of several hundreds mm/sec by being engaged in convex parts and concave parts of the inner roll and the outer roll when embossing of the first surface ("EMBOSS") is conducted. However, in a non-shaped section (between the "EMBOSS" and "NEWCAN"), the inner roll and the outer roll cannot engage the can barrel since no concave parts and convex parts are formed, and hence, the can barrel is stopped (or slowed down), and as a result, embossing of the second surface ("NEWCAN") cannot be conducted at a predetermined position.

The present invention has been made in order to solve the above-mentioned problem, and is aimed at providing an embossing device, an embossing method and an embossed can which enable embossing having a non-shaped section and an arbitral number of embossed areas and are capable of improving quality, productivity or the like.

Means for Solving the Subject

In order to solve the above object, the embossing device of the present invention is an embossing device which comprises an embossing turret for conducting embossing on a can barrel, wherein the embossing turret is provided with:

an inner roll and an outer roll which revolve and rotate on its axis around the rotational shaft in a synchronized way;

a holding means which revolves around the rotational shaft while conducting the predetermined contact and retract movement and the predetermined swing movement, thereby to allow the can barrel to rotatably hold;

a driving means which allows the can barrel which is held by the holding means to rotate on its axis;

a sensor which detects a match mark on the can barrel;

an encoder which is attached to the rotational shaft; and a rotational positioning controller which receives signals from the sensor and the encoder and controls the driving means based on these signals;

wherein embossing is conducted on the can barrel in the state where the can barrel is rotated on its axis at the same circumferential speed as that of the inner roll.

Further, the embossing method of the present invention is an embossing method in which embossing is conducted on a can barrel by using an embossing turret of an embossing device, which comprises the steps of:

positioning the can barrel which is held by the holding means of the embossing turret between the predetermined positioning start position and the predetermined positioning position while allowing the can barrel to rotate on its axis; and embossing the can barrel which has been positioned and is rotating on its axis in the state where the can barrel is allowed to rotate at the same circumference speed as the circumference speed of the rotation on its axis of the inner roll.

Further, the embossed can according to the present invention is an embossed can which is embossed by the embossing method according to claim 7.

Advantageous Effects of the Invention

According to the embossing device, the embossing method and the embossed can of the present invention, it is possible to conduct embossing which has a non-shaped section and an arbitral number of embossed areas and also to improve quality and productivity. In particular, in the case of a double-embossed surface can, it is possible to realize an innovative design, and as a result, to improve the additional value.

MODE FOR CARRYING OUT THE INVENTION

Figure 1:
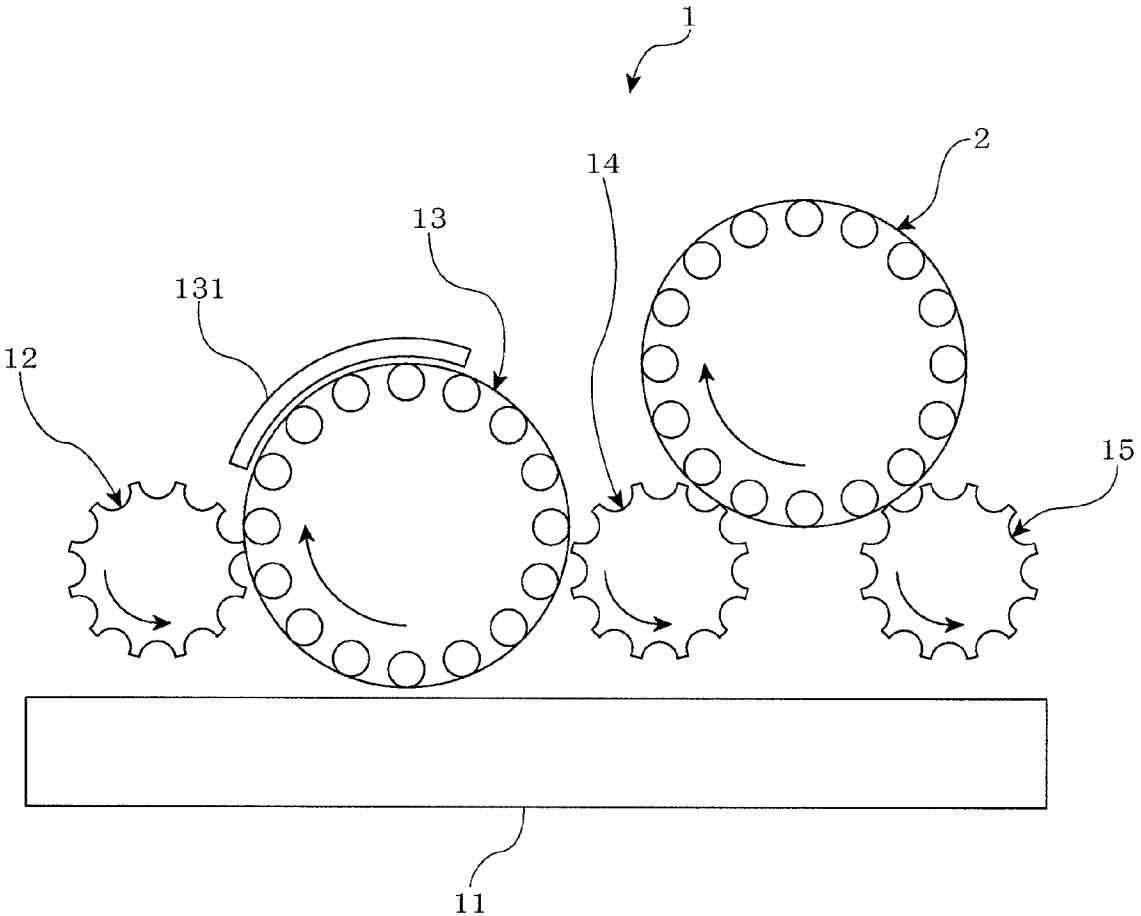
FIG. 1 is a schematic view of an embossing device according to one embodiment of the present invention.

One Embodiment of an Embossing Device, an Embossing Method and an Embossed Can FIG. 1 shows a schematic view of an embossing device according to one embodiment of the present invention.

In FIG. 1, the embossing device 1 of this embodiment has a configuration in which, on a base 11, a can barrel supply turret 12, a heating turret 13, a can barrel transfer turret 14, an embossing turret 2 which conducts embossing on a can barrel 101, a can barrel transportation turret 15 or the like.

Further, since other configurations than the embossing turret 2 are almost similar to those of the embossing device disclosed in the above-mentioned Patent Document 3, a detailed explanation thereof is omitted.

In the embossing device 1, the can barrel supply turret 12 supplies the can barrel 101 to a heating turret 13.

The heating turret 13 has a high-frequency coil 131, and heats the can barrel 101 while allowing it to be rotated on its axis. As a result, damage or peeling by embossing of a coating, a film or the like of the inner surface or the outer surface of the can barrel 101 can be effectively prevented.

Here, the heating turret 13 may supply the can barrel 101 to the can barrel turret 14 after positioning by detecting a match mark 102 of the can barrel 101. By doing this, the can barrel 101 which has been positioned is transported in the state that the rotation on its axis is stopped. Although the can barrel 101 slightly rotates by transfer or the like at the can barrel transfer turret 14, it is supplied to the embossing turret 2 in the state that it directs to almost the fixed range direction. Therefore, the time required for positioning in the embossing turret 2 is shortened, and a high-speed operation becomes possible. As a result, the productive capacity of the embossing device 1 can be enhanced.

Further, the can barrel transfer turret 14 supplies the can barrel 101 which has been heated and positioned to the embossing turret 2.

(Embossing Turret)

Figure 2:
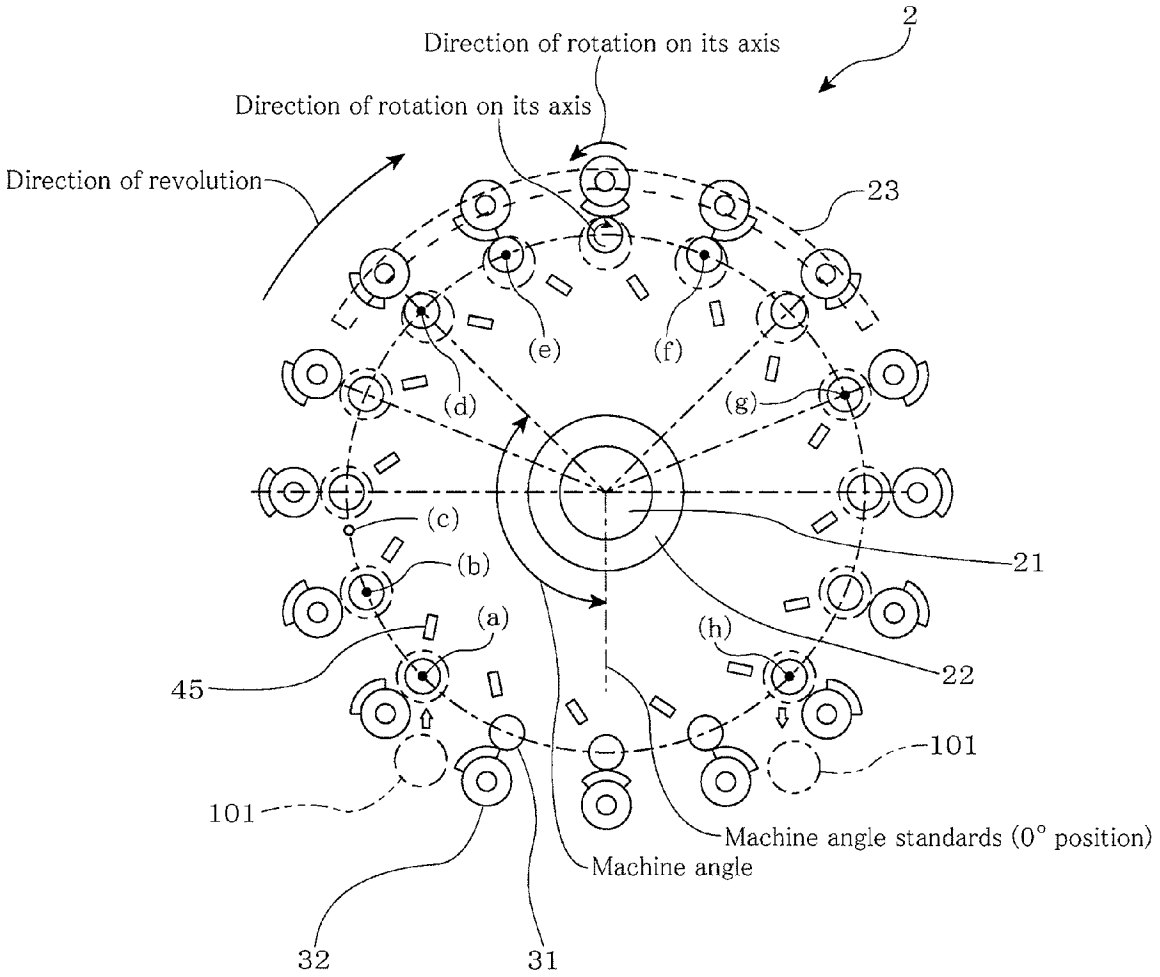
FIG. 2 is a schematic view for explaining the relationship between the inner roll, the outer roll and the can barrel of the embossing device according to one embodiment of the present invention.

FIG. 2 is a schematic view for explaining the relationship between the inner roll, the outer roll and the can barrel of the embossing device according to one embodiment of the present invention.

In FIG. 2, the embossing turret 2 has a configuration in which a plurality of inner rolls 31 and outer rolls 32 (respectively 16 in this embodiment), a holding means 4 provided such that it corresponds to each inner roll 31, a stepping motor 43 provided in each holding means 4, a sensor 45 provided in each holding means 4, an encoder 22 which is attached to a rotational shaft 21, a rotational positioning controller 5 for controlling the stepping motor 43 or the like are provided.

The embossing turret 2 of this embodiment differs from the embossing part (embossing turret) disclosed in the above-mentioned Patent Document 3 in that it is provided with the encoder 22 and the rotational positioning controller 5. Other configurations of the embossing turret 2 are almost similar to those of the above-mentioned embossing part, and hence, a detailed explanation thereof is omitted.

The inner roll 31 and the outer roll 32 are arranged at an equal interval around the rotational shaft 21, and are respectively attached to the two shafts which rotate in a synchronized manner with the rotational shaft 21 by a planet gear.

Figure 3A:
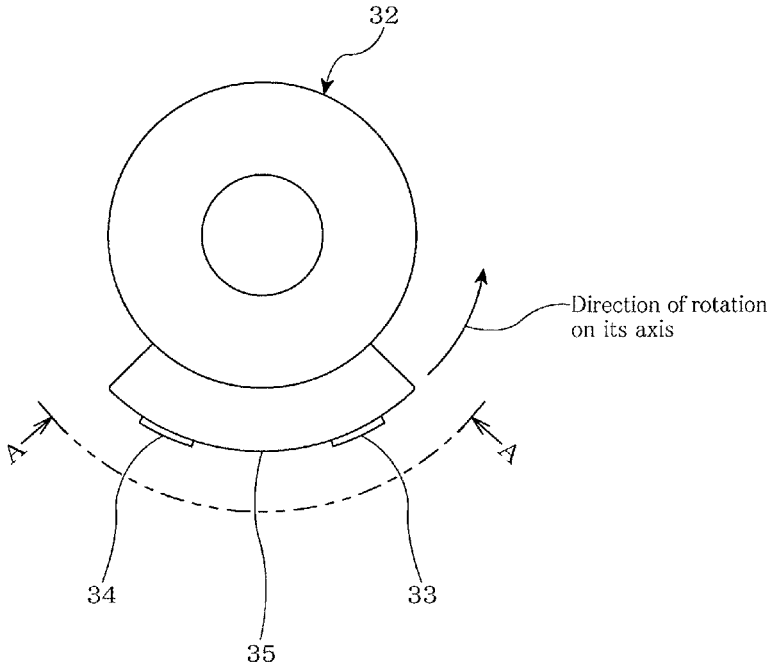
FIG. 3A is a schematic plan view for explaining the outer roll of the embossing device according to one embodiment of the present invention.

FIG. 3A is a schematic plan view for explaining the outer roll of the embossing device according to one embodiment of the present invention.

Figure 3B:
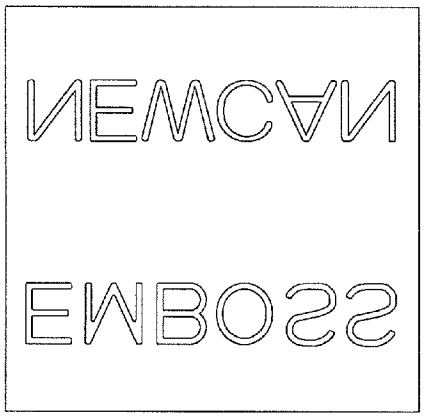
FIG. 3B is a schematic view for explaining the outer roll of the embossing device according to one embodiment of the present invention, showing a developmental view taken by an arrow A-A.

FIG. 3B is a schematic view for explaining the outer roll of the embossing device according to one embodiment of the present invention, showing a developmental view taken by an arrow A-A.

In FIG. 3A and FIG. 3B, the outer roll 32 has two embossing regions (that is, a first embossing region 33 and a second embossing region 34) which are distant from each other in a circumferential direction with a non-shaped section 35 being therebetween. In the first embossing region 33, a convex part corresponding to the character "EMBOSS" is formed, and in the second embossing region 34, a convex part corresponding to the character "NEWCAN" is formed.

Although not shown, almost as in the case of the outer roll 32, the inner roll 31 has two embossing regions which are distant from each other in a circumferential direction. In the first embossing region, a concave part corresponding to the character "EMBOSS" is formed, and in the second embossing region, a concave part corresponding to the character "NEWCAN" is formed.

Figure 4:
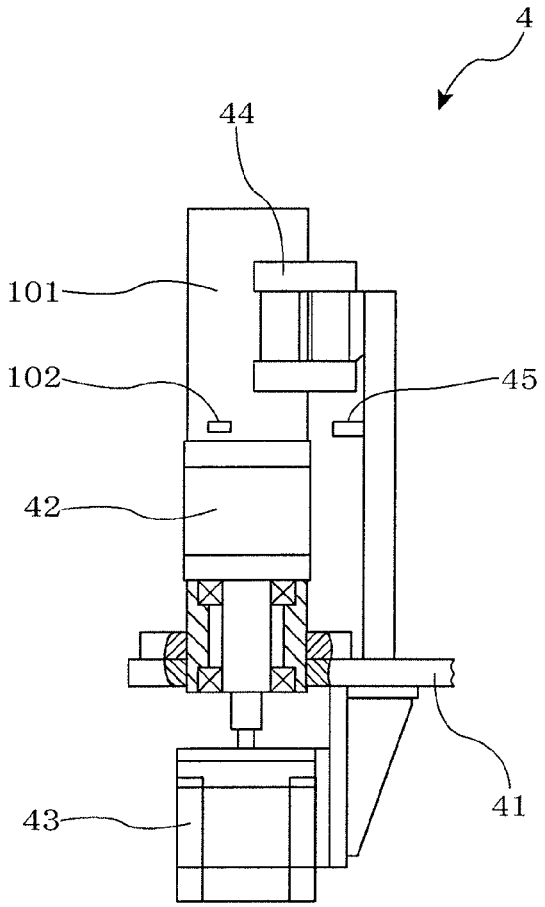
FIG. 4 is a schematic side view of a holding means of an embossing turret of the embossing device according to one embodiment of the present invention.

FIG. 4 shows a schematic side view of the holding means of the embossing turret of the embossing device according to one embodiment of the present invention.

In FIG. 4, the holding means 4 is provided with a base 41, a chuck 42, a stepping motor 43, a can pocket (can-supporting means) 44, a sensor 45 and the like.

The base 41 is arranged at an equal interval around the rotational shaft 21, and is attached to a shaft which swings in a synchronized manner with the rotational shaft 21 by a cam mechanism. Specifically, the base 41 moves as follows: It contacts and retracts the inner roll 31 by a sliding body, a sliding cam mechanism or the like. Further, by a cam mechanism for swing movement using the cam element 23, it swings in a direction in which the can barrel 101 is pushed to the inner roll 31.

The chuck 42 has an almost cylindrical shape, and a magnet or the like is embedded in the upper surface thereof. This chuck 42 is rotatably attached to the base 41, and rotates by means of the stepping motor 43 as the driving means. The can pocket 44 has a plurality of can barrel mounting rollers, magnets and the like.

The sensor 45 is attached to the supporting member for the can pocket 44, and detects the match mark 102 of the can barrel 101 which is held by the chuck 42.

The holding means 4 with the above-mentioned mechanism revolves around the rotational shaft 21 while conducting the predetermined contacting and retracting movements and swing movement, and holds the can barrel 101 such that its can rotate on its axis. Further, the stepping motor 43 allows the can barrel 101 which is held by the chuck 42 to rotate on its axis.

Further, the stepping motor 43 is used in order to allow the can barrel 101 to rotate. The means to rotate the can barrel 101 is not limited to the stepping motor 43. For example, a servo motor, a motor provided with an encoder or the like which can control the rotation speed can be used.

The can barrel 101 of this embodiment has a bottomed cylindrical shape, and has a rectangular match mark 102 at one location of the side.

The shape or quantity of the match mark 102 is not limited to those mentioned above. Further, the can barrel 101 is described as the can barrel for a two-piece can, but the application of the can barrel 101 is not limited to a two-piece can. For example, the can barrel 101 can also be applied to a three-piece can in which a can bottom is provided at one side of the barrel.

Further, the encoder 22 is attached to the rotational shaft 21, and normally, an encoder having a dissolving power of several hundreds to several thousands pulses is used. In this embodiment, by attaching the encoder 22 to the rotational shaft 21, almost all controls can be conducted by the output pulse of the encoder 22.

Figure 5:
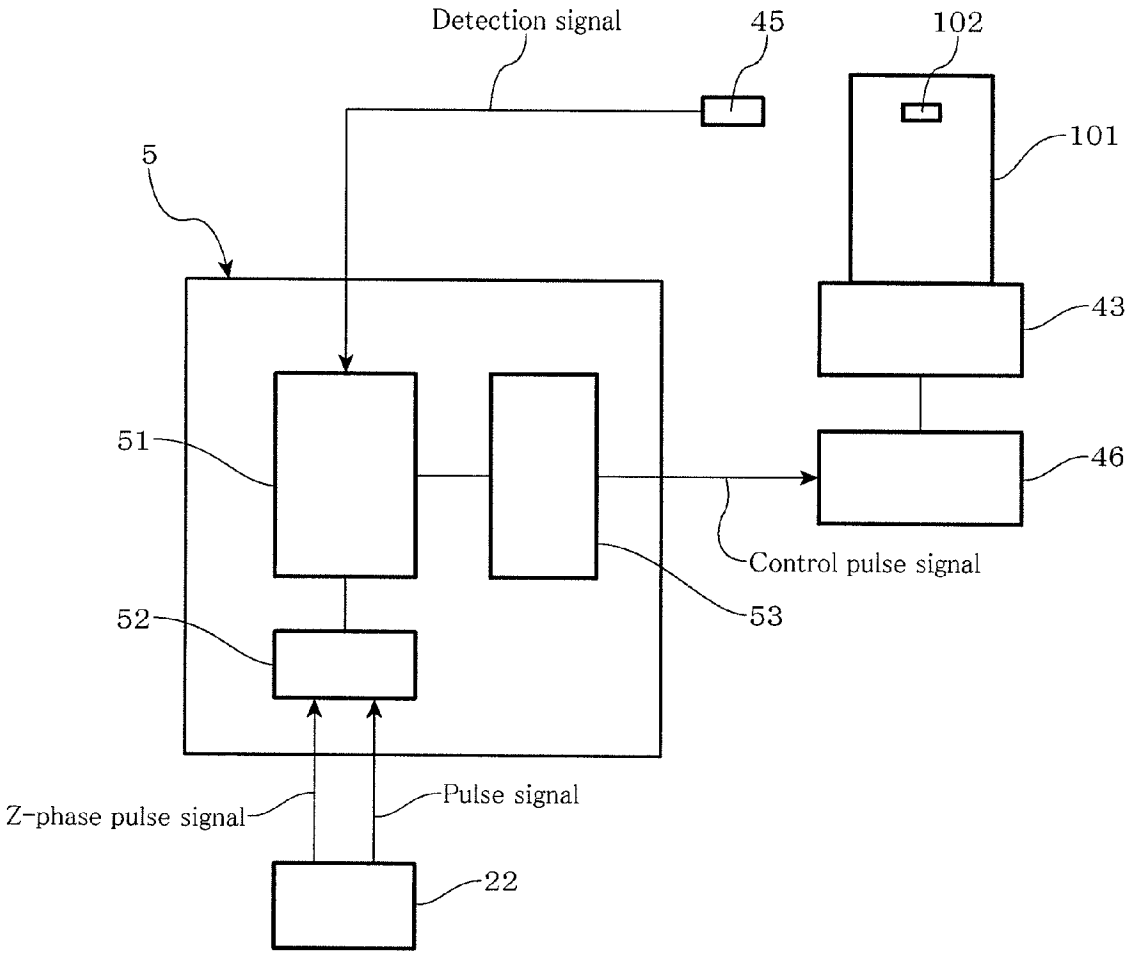
FIG. 5 is a schematic block diagram for explaining a rotational positioning controller of an embossing turret of the embossing device according to one embodiment of the present invention.

FIG. 5 is a schematic block diagram for explaining a rotational positioning controller of an embossing turret of the embossing device according to one embodiment of the present invention.

In FIG. 5, the rotational positioning controller 5 receives detection signals from the sensor 45 and signals from the encoder 22 (Z-phase pulse signals and pulse signals), and based on these signals, control pulse signals are output to the driver 46, and the driver 46 controls the stepping motor 43.

In this embodiment, the rotational positioning controller 5 has a calculation processing part 51, a machine position detection part 52 and a pulse control part 53.

In correspondence with each holding means 4, 16 rotational positioning controllers 5 are provided.

The calculation processing part 51 has a CPU (central processing unit) or the like, and is connected with the machine position detection part 52, the pulse control part 53 and the sensor 45. This calculation processing part 51 occasionally receives the positional (machine angle) information of the corresponding inner roll 31. Further, when it receives from the sensor 45 detection signals that the match mark 102 has been detected, it obtains the amount of positional variations of the can barrel 101 which is held, and outputs control information for correcting the amount of variations to the pulse control part 53.

The machine position detection part 52 receives Z-phase pulse signals and pulse signals from the encoder 22, and by counting pulse signals after receiving the Z-phase pulse signals, the position of the inner roll 31 (machine angle) is calculated. This machine position detection part 52 outputs the position (machine angle) information or the like of the inner roll 31, which has been calculated, to the calculation processing part 51.

The pulse control part 53 as the driving means control part, when it receives from the calculation processing part 51 control information for correcting the amount of positional variations, outputs control pulse signals to the driver 46 based on this control information. As a result, the driver 46 controls the rotation speed on its axis of the stepping motor 43, whereby the positional correction of the can barrel 101 is conducted. Further, pulse signals of the encoder 22 can be used for generation of control pulse signals, whereby reliability or the like of the control system can be improved.

By providing the above-mentioned rotational positioning controller 5, the embossing turret 2 can conduct all controls by the output pulse from the rotational shaft 21 (pulse signals from the encoder 22). As a result, positioning control can be conducted easily and without fail by inputting numerical values to the operation means (not shown) of the rotational positioning controller 5. Therefore, the control operation time required to align the shaping position to the design can be significantly reduced, whereby productivity can be increased.

The can barrel transportation turret 15 discharges the can barrel 101 which has been embossed by means of the embossing turret 2.

Next, the operation of the embossing device 1 with the above-mentioned configuration and the embossing method of this embodiment will be explained with reference to the drawings. In the meantime, the embossing method of this embodiment is a method of embossing the can barrel 101 using the embossing turret 2 of the above-mentioned embossing device 1.

Figure 6:
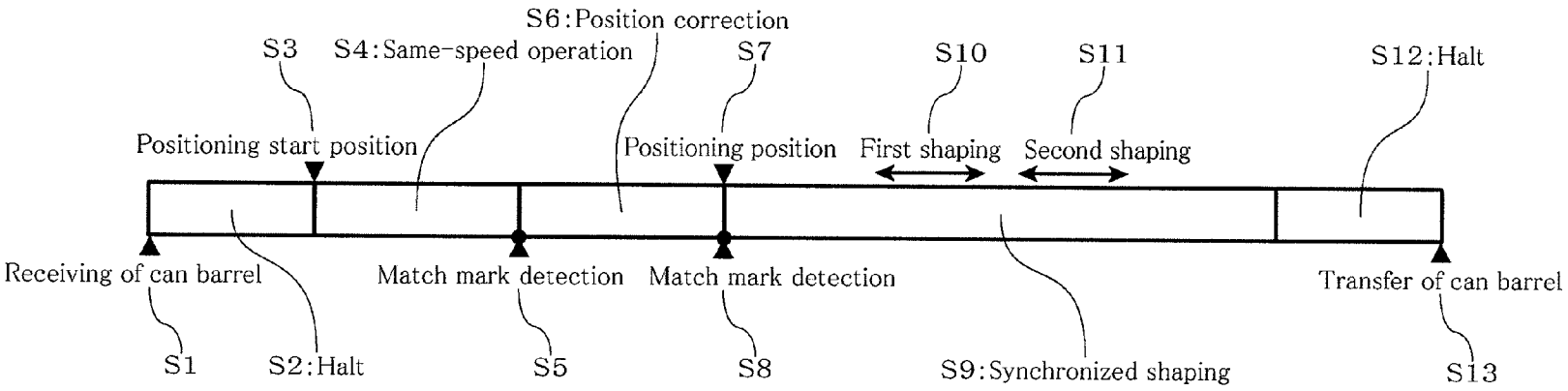
FIG. 6 is a schematic view for explaining an embossing method according to one embodiment of the present invention.

FIG. 6 is a schematic view for explaining an embossing method according to one embodiment of the present invention.

In FIG. 6, the can barrel 101 is supplied to the embossing turret 2 from the can barrel transfer turret 14. That is, at the point (a) shown in FIG. 2, the embossing turret 2 receives the can barrel 101 from the can barrel transfer turret 14 (Step S1). At this time, the machine position detection part 52 of the rotational positioning controller 5 has counted the number of pulse signals after inputting Z-phase pulse signals. In the meantime, when the embossing turret 2 rotates by 360°, the number of pulse signals counted is 4000. Therefore, the number of pulse signals is 500.

Subsequently, the rotational positioning controller 5 keeps the state in which the control pulse signals are not output to the driver 46. That is, the state in which the stepping motor 43 is stopped (the state in which the rotation on its axis of the can barrel 101 is stopped) is maintained (Step S2). By keeping the state in which the stepping motor 43 is stopped, the holding means 4 can hold the can barrel 101, which has been supplied, without fail.

Subsequently, the can barrel 101, which is held, revolves to the point (b) shown in FIG. 2, and reaches the position at which the positioning starts (Step S3). At this time, the number of pulse signals counted by the machine position detecting part 52 is 750.

The positioning start position and the positioning position, which will be mentioned later, are setting parameters, and hence, are set according to the processing speed or the like.

Subsequently, the rotational positioning controller 5 outputs to the driver 46 control pulse signals for allowing the can barrel 101 to rotate on its axis at the same circumference speed as that of the circumference speed of the rotation on its axis of the inner roll 31. As a result, the stepping motor 43 rotates, and the can barrel 101, which is held, rotates at the same circumference speed as that of the circumference speed of the rotation on its axis of the inner roll 31 (Step S4).

Meanwhile, the state in which the can barrel 101 rotates at the same circumference speed as that of the circumference speed of the rotation on its axis of the inner roll 31 is called as the "same speed operation".

Subsequently, the sensor 45 detects the match mark 102 on the can barrel 101 which rotates at the same circumference speed as that of the circumference speed of the rotation on its axis of the inner roll 31 (that is, which operates at the same speed") (Step S5), and then outputs the detection signals to the calculation processing part 51 of the rotational positioning controller 5.

The calculation processing part 51, upon receipt of the detection signals, obtains the amount of positional variations of the can barrel 101 based on the positional (machine angle) information of the inner roll 31 from the machine position detection part 52. Then, control information for correcting the amount of positional variations is output to the pulse control part 53. Subsequently, upon receipt of control information for correcting the amount of positional variations from the calculation processing part 51, the pulse control part 53 outputs pulse signals for control to the driver 46 based on this control information. As a result, the driver 46 controls the speed of the rotation on its axis of the stepping motor 43, whereby the correction of the position of the can barrel 101 is conducted (Step S6).

Here, the calculation processing part 51 confirms that the match mark 102 is detected by the sensor 45 at the point (c) shown in FIG. 2 based on the positional (machine angle) information of the inner roll 31 from the machine position detection part 52 (normally, the number of pulse signals counted by the machine position detection part 52 (for example, 910)) at the time of receiving detection signals.

Subsequently, by comparing the point (c) with the positional (machine angle) information of the ideal state which suffers no positional variations (normally, the number of pulse signals counted by the machine position detection part 52 is 1000, for example), the calculation processing part 51 can obtain the amount of positional variations. That is, in the case of the ideal state suffering no positional variations, the number of pulse signals counted should be 1000. However, the calculation processing part 52 receives detection signals when the number of pulse signals counted is 910. Therefore, the amount of positional variations is an amount corresponding to the number of counted signals of 90 in the advance direction.

Subsequently, the calculation processing part 51 outputs to the pulse control part 53 control information for correcting the amount of positional variations corresponding to the number of counted signals of 90 in the advance direction, i.e. control signals for slowing the rotation speed of the stepping motor 43. As a result, the driver 46 slows down the revolution speed of the stepping motor 43, whereby the positional correction of the can barrel 101 is conducted. On the contrary, the positional correction of the can barrel 101 may be conducted by increasing the rotational speed of the stepping motor 43.

Then, the can barrel 101 which rotates on its axis by the stepping motor 43 revolves to the point (d) shown in FIG. 2, and reaches the positioning position (Step S7). At this time, the number of pulse signals counted by the machine position detection part 52 is 1500.

As mentioned above, in this embodiment, the rotational positioning controller 5 conducts positioning from the predetermined positioning start position to the predetermined positioning position while allowing the can barrel 101 to rotate on its axis, and it does not stop the rotation on its axis of the can barrel 101 from the predetermined positioning start position to the predetermined positioning position. Therefore, a defect that the positioning accuracy is lowered by suddenly switching from the halt state to the same speed operation can be avoided.

The rotational positioning controller 5 allows the can barrel 101 to rotate on its axis at the same circumference speed as that of the circumference speed of the rotation on its axis of the inner roll 31. When the sensor 45 detects the match mark 102, the rotational speed of the stepping motor 43 is controlled, whereby the position of the can barrel 101 is corrected.

Here, the rotational positioning controller 5 may obtain the amount of positional variations (error in positioning) based on signals from the sensor 45 which has detected the mach mark 102 in the vicinity of the above-mentioned positioning position, thereby to confirm that the amount of positional variations is less than the predetermined threshold value (Step S8). If the amount of positional variations exceeds the predetermined threshold value, the rotational positioning controller 5 may output emergency signals. In this way, the positioning state before shaping can be confirmed, whereby the reliability of quality can be increased.

Subsequently, the rotational positioning controller 5 outputs to the driver 46 control pulse signals for allowing the can barrel 101 to rotate on its axis at the same circumference speed as that of the circumference speed of the rotation on its axis of the inner roll 31. As a result, the stepping motor 43 rotates, and the can barrel 101, which is held, rotates at the same circumference speed as that of the circumference speed of the inner roll 31 in the state in which the position has been corrected (that is, the state suffering almost no positional variations) (Step S9).

In the meantime, the state in which the can barrel 101 rotates on its axis at the same circumference speed as that of the circumference speed of the inner roll 31 in the state which suffers almost no positional variations) is called as the "synchronized operation state".

In the embossing turret 2, between the point (e) and the point (f) shown in FIG. 2, the first processing is conducted (Step S10). Further, the second processing is conducted (Step S11).

Further, the number of pulse signals counted by the machine position detection part 52 at the point (e) is 1750, and the number of pulse signals counted by the machine position detection part 52 at the point (f) is 2250.

Here, the embossing turret 2 of this embodiment can conduct embossing on the can barrel 101 in the state where the can barrel 101 is position-corrected (the state which suffers almost no positional variations) and in the state where the can barrel 101 rotates on its axis at the same circumference speed as that of those of the inner roll 31 and the outer roll 32 ("synchronized movement state").

In this way, generation of molding scars in the embossing can be suppressed. Further, since the embossing positioning accuracy for the design can be improved, appearance can be improved.

Further, as mentioned above, the inner roll 31 and the outer roll 32 of this embodiment has two embossing regions which are distant from each other with the non-shaped section 35 therebetween (that is, the first embossing region 33 and the second embossing region 34), and hence, the embossing turret 2 can produce double-embossed surface cans which conventionally could not be produced.

Then, the can barrel 101, which is held, is allowed to move in a synchronized manner to the point (g) shown in FIG. 2. Subsequently, the rotational positioning controller 5 keeps the state where the control pulse signals are not output to the driver 46. That is, the state where the stepping motor 43 is halted (the state in which the rotation on its axis of the can barrel 101 is halted) is maintained (Step S12).

Subsequently, the embossing turret 2 supplies the embossed can barrel 101 to the can barrel transportation turret 15. That is, the embossing turret 2, at the point (h) shown in FIG. 2, transfers the can barrel 101 to the can barrel transportation turret 15 (Step S13). At this time, the number of pulse signals counted by the machine detection part 52 is 3500.

Next, the embossed can 10 of this embodiment will be explained with reference to the drawings.

Figure 7:
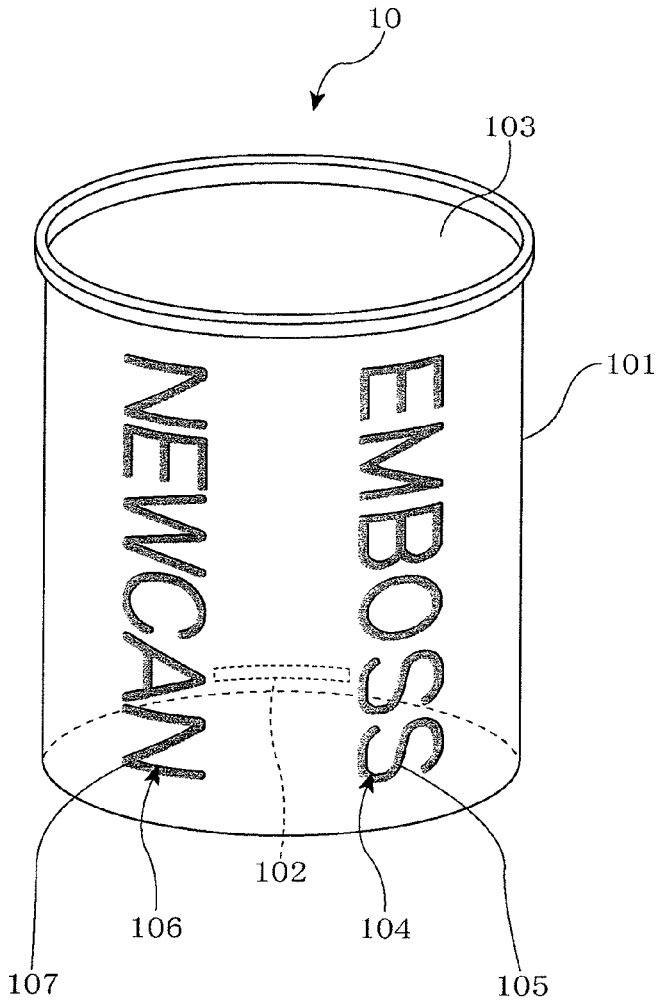
FIG. 7 is a schematic perspective view of an embossed can according to one embodiment of the present invention.

FIG. 7 is a schematic perspective view of the embossed can according to one embodiment of the present invention.

In FIG. 7, the embossed can 10 has the can barrel 101 and a can lid 103. This embossed can 10 is a double-embossed surface can, which is obtained by embossing by using the embossing device 1 and the embossing method as mentioned above.

That is, on the can barrel 101, the first pattern 104 ("EMBOSS") is printed, and the first concave portion 105 ("EMBOSS") is formed in the state that it is so positioned as to almost conform to the first pattern 104. Further, at a position which is distant in the circumferential direction with the non-shaped section therebetween, the second pattern 106 ("NEWCAN") is printed, and the second concave portion 107 ("NEWCAN") is formed in the state that it is so positioned as to almost conform to the second pattern 106.

As mentioned above, according to the embossing device 1, the embossing method and the embossed can 10 according to this embodiment, it is possible to conduct embossing having a non-shaped section and an arbitral number of embossing regions, whereby the quality or productivity can be improved. In particular, the embossed can 10 which is a double-embossed surface can is able to have an innovative design, whereby additive value can be improved.

Hereinabove, the embossing device, the embossing method and the embossed can of the present invention were explained with reference to preferred embodiments. The embossing device, the embossing method and the embossed can of the present invention are not limited to the above-mentioned embodiments or the like. It is needless to say various modifications are possible within the scope of the present invention.

For example, an explanation was made hereinabove taking the embossing as an example, in particular. However, the present invention can be applied to other processing which requires accurate rotational positioning of the can barrel while allowing the can barrel to rotate on its axis at a predetermined speed.

The invention claimed is:

1. An embossing device for embossing on a can barrel by an embossing turret, the embossing device comprising:

a plurality of inner rolls and a plurality of outer rolls each rotating on a corresponding axis of the inner roll and a corresponding axis of the outer roll and revolving around a rotational shaft of the embossing turret in a synchronized way;

a plurality of holding units revolving around the rotational shaft while conducting a predetermined contact and retract movement wherein at least one of the holding units contacts with and retracts from at least one of the inner rolls and a swing movement wherein at least one of the holding units is adapted to swing and push the can barrel to at least one of the inner rolls to rotatably hold the can barrel;

a driving unit for rotating the can barrels, held by the plurality of holding units; and an encoder attached to the rotational shaft;

wherein each of the plurality of holding units includes a sensor for detecting a match mark on the can barrel, and a rotational positioning controller for receiving signals from the sensor and the encoder and controlling the driving unit based on the signals, and the rotational positioning controller comprises a calculation processing part, a machine position detection part, and a control part for the driving unit, and the rotational positioning controller is configured so that from a predetermined positioning start position to a position where the sensor detects the match mark, the can barrel is adapted to be rotated at a circumferential speed same as a circumferential speed of at least one of the inner rolls, from the position where the sensor detects the match mark to a predetermined positioning position, an amount of positional variations of the can barrel with the corresponding inner roller is adapted to be obtained and a speed of a rotation of the can barrel based on the amount of positional variations is adapted to be controlled to correct a position of the can barrel, and from the predetermined positioning position, the inner roll and the outer roll are synchronously operated for embossing the can barrel.

2. The embossing device according to claim 1, wherein the plurality of inner rolls and the outer rolls each have a non-shaped section and an arbitral number of embossing regions.

3. The embossing device according to claim 1, wherein the rotational positioning controller calculates an error in positioning based on the signals from the sensor which are detected in a vicinity of the predetermined positioning position, and outputs emergency signals if the error in positioning exceeds a predetermined threshold value.

* * * * *